United States Patent [19]

Bisbing

[11] Patent Number: 4,630,332

[45] Date of Patent: Dec. 23, 1986

[54] ADJUSTABLE FRICTION PLASTIC HINGE HAVING NON-SQUEAK PROPERTIES

[75] Inventor: Robert H. Bisbing, Springfield, Pa.

[73] Assignee: Southco, Inc., Concordville, Pa.

[21] Appl. No.: 800,911

[22] Filed: Nov. 25, 1985

Related U.S. Application Data

[63] Continuation of Ser. No. 669,611, Nov. 8, 1984, abandoned.

[51] Int. Cl.[4] ..... E05D 11/08

[52] U.S. Cl. ..... 16/273; 16/340; 16/385; 16/DIG. 13

[58] Field of Search ..... 16/228, 273, 338, 339, 16/340, 342, 380, 381, 385, 386, DIG. 13, DIG. 27

[56] References Cited

U.S. PATENT DOCUMENTS

| | | | |
|---|---|---|---|
| 1,818,182 | 8/1931 | Woernle | 16/340 |
| 2,412,120 | 12/1946 | Bouchard | 16/228 X |
| 3,015,126 | 1/1962 | Ahlgren | 16/386 |
| 3,991,436 | 11/1976 | Nagase | 16/273 |
| 4,193,164 | 3/1980 | Okayama | 16/DIG. 13 X |
| 4,329,758 | 5/1982 | Fohl | 16/273 |

FOREIGN PATENT DOCUMENTS

| | | | |
|---|---|---|---|
| 273333 | 9/1964 | Australia | 16/385 |
| 2035908 | 2/1972 | Fed. Rep. of Germany | 16/273 |
| 20279 | of 1889 | United Kingdom | 16/381 |

*Primary Examiner*—Fred A. Silverberg
*Attorney, Agent, or Firm*—Paul & Paul

[57] ABSTRACT

An adjustable friction hinge assembly for use on the lid or cover of a record player is made of plastic material. The hinge has anti-squeak properties to prevent squeaking when the lid or cover is raised. The hinge also has the capability of holding the lid, when raised, in the raised position without falling down. The knuckles of the hinge and the adjustment pin are made of a first plastic material having elastic properties, preferably acetal, while a washer of a different plastic material, preferably nylon, is placed between the facing end surfaces of the movable knuckles. The two different plastics are so selected that, when the two materials are in frictional engagement with each other, the coefficients of static and dynamic friction are similar. This avoids squeaking. The plastic adjustment pin passes through one end knuckle having an internal shoulder and screws into the other end knuckle. The head of the pivot pin abuts against the internal shoulder. When the screw is tightened to draw the facing knuckles toward each other and against each of the nylon washers, the plastic screw elongates slightly and sufficient reaction force is applied by the threads of the screw on the threads of the threaded knuckle to maintain the lid in the raised or other position in which it is placed.

7 Claims, 6 Drawing Figures

ADJUSTABLE FRICTION PLASTIC HINGE HAVING NON-SQUEAK PROPERTIES

REL. U.S. DATA

This application is a File Wrapper Continuing (FWC) Application of original U.S. application Ser. No. 06/669,611, filed Nov. 8, 1984 entitled ADJUSTABLE FRICTION PLASTIC HINGE HAVING NON-SQUEAK PROPERTIES, now abandoned.

BACKGROUND OF THE INVENTION

This invention relates to a relatively small hinge assembly for a lid or cover or the like, and in particular to a hinge assembly for a lid or cover which, when opened, is intended to remain in an open position and not swing shut.

The invention relates particularly to a hinge assembly for a lid or cover which, when raised, is intended to remain in the raised position and not fall down.

In a co-pending patent application, Ser. No. 509,361, filed June 30, 1983 by James H. Vickers, now U.S. Pat. No. 4,490,884, issued Jan. 1, 1985, assigned to Southco, Inc., the assignee of the present application, an adjustable friction hinge assembly is described and claimed in which the friction between the hinge pin and the middle knuckle of a two-leaf three-knuckle assembly is controllable. In the Vickers construction, the hinge pin in the two spaced-apart knuckles is fixed against rotation, and the frictional resistance to movement of the two leaves relative to each other is controlled solely by adjustment of the middle or clamping knuckle. This control is achieved by adjusting an adjustment screw to tighten or to loosen the embracement of the cylindrical central portion of the hinge pin by the middle knuckle.

The adjustable friction hinge which is the subject of the present application is entirely different in design from that used by Vickers.

SUMMARY OF THE INVENTION

A principal object of the present invention is to provide a small adjustable friction hinge which does not squeak and which is clean and neat in appearance and adapted for use on furniture or articles used in the home, such for example, as the cover or lid of a record player.

The foregoing object is achieved by designing a hinge made of plastic. In a preferred form of three-knuckle hinge the desired friction is derived from the endwise contact between a nylon washer and the facing end surfaces of acetal plastic knuckles of the hinge under the force generated by an elastic plastic torque-adjusting screw which elongates slightly when tightened and which is positioned on the pivot axis and functions also as the pivot pin.

DETAILED DESCRIPTION OF THE PREFERRED EMBODIMENTS

Figure 1:
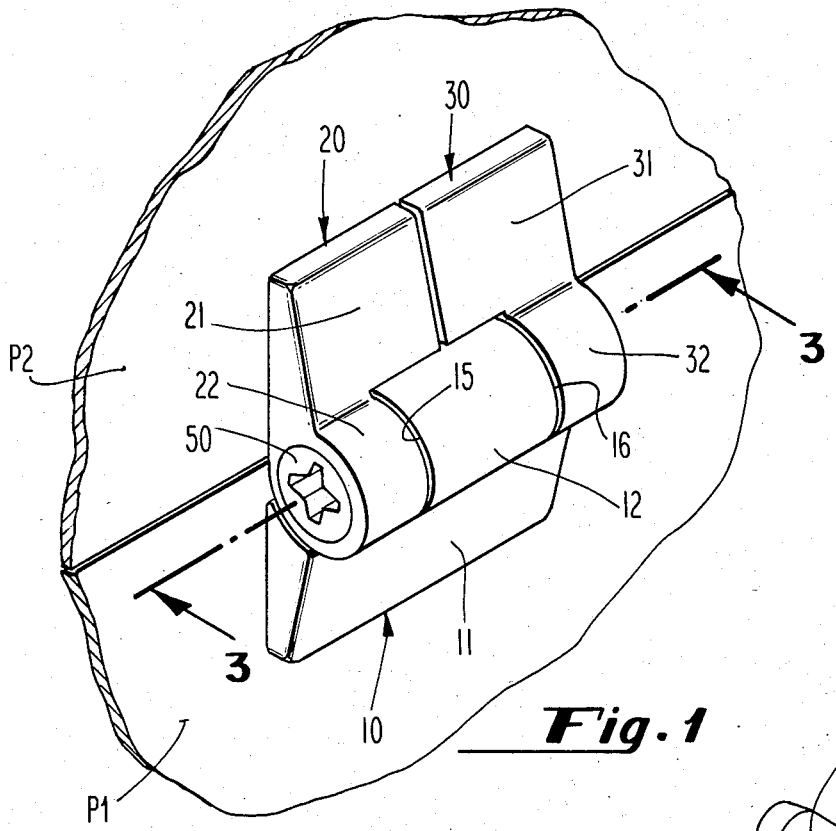
FIG. 1 is a perspective view of a preferred form of three-knuckle hinge embodying the invention.
Figure 2:
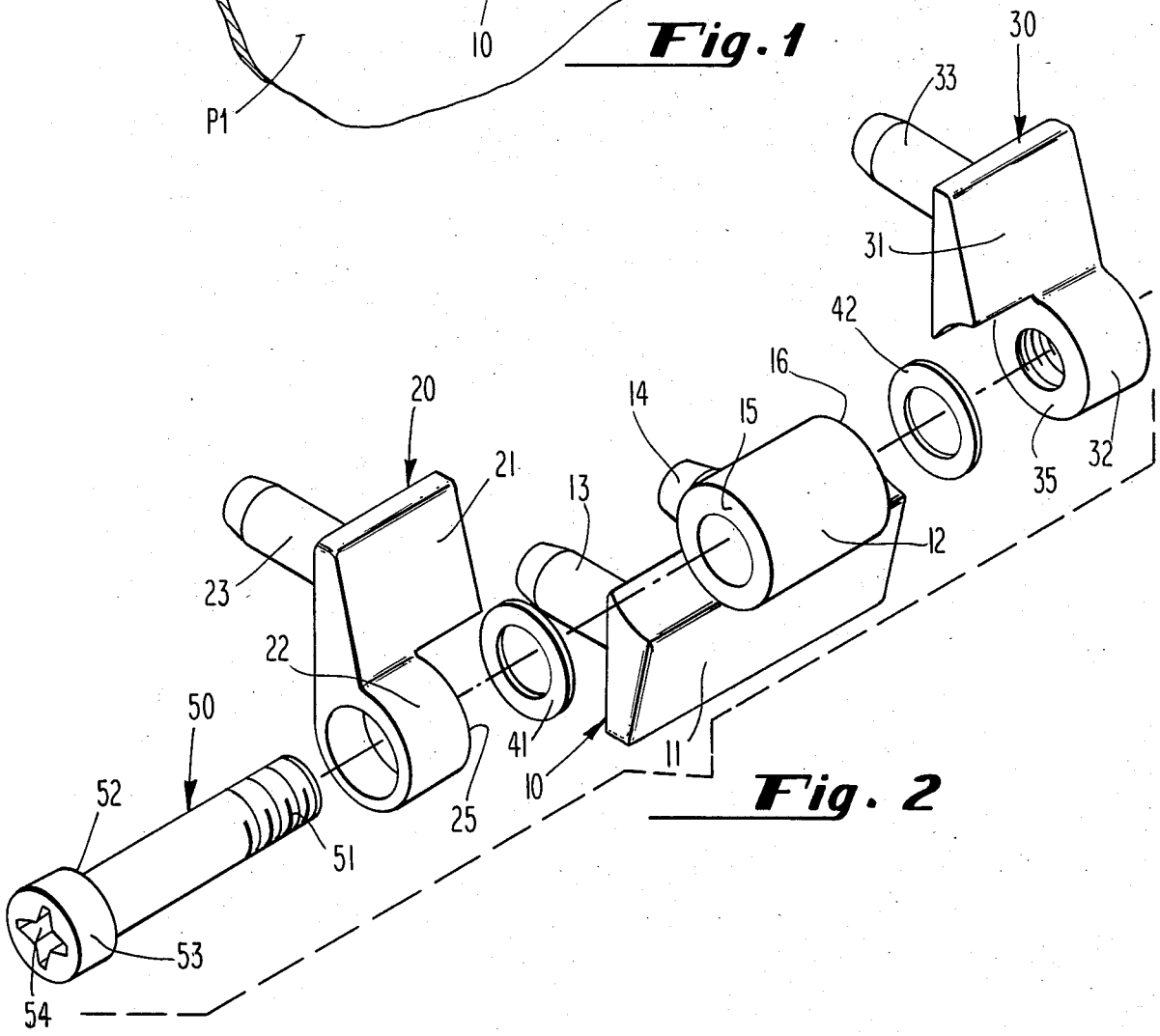
FIG. 2 is an exploded perspective view of the component parts of the new hinge assembly.
Figure 4:
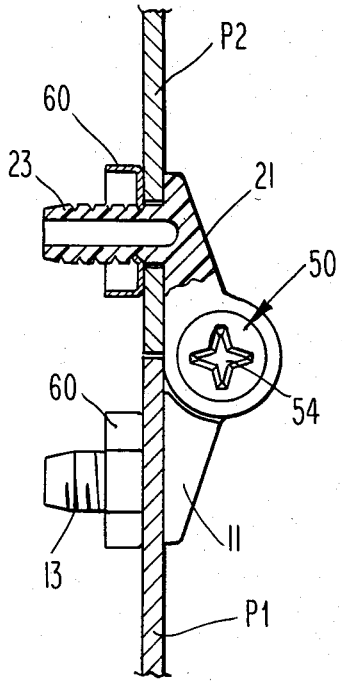
FIG. 4 is a view looking along the line 4—4 of FIG. 3.
Figure 3:
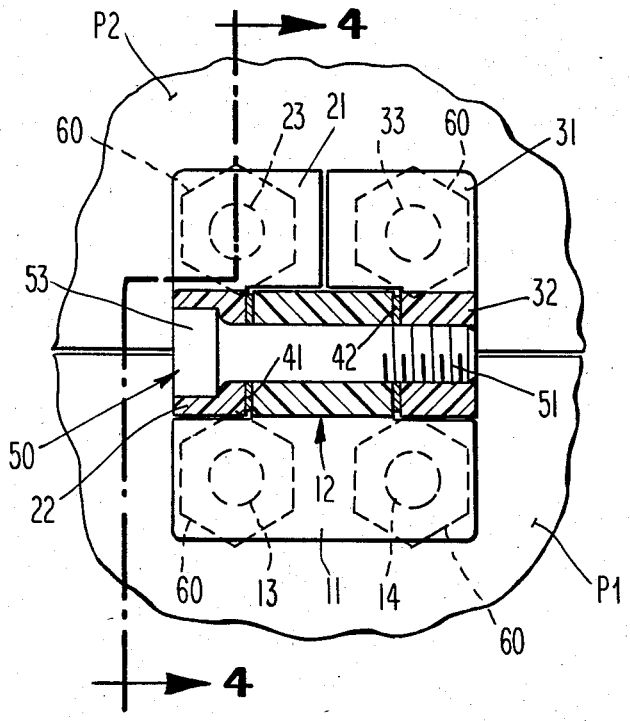
FIG. 3 is a front view partly in section of the hinge assembly.

In the adjustable friction hinge of the present application, the desired friction is provided by the endwise contact of plastic washer-shaped surfaces 41 and 42 shown in FIG. 2 and positioned between the end surfaces 25, 15, 16 and 35 of the knuckles 22, 12, and 32 of hinge components 10, 20, and 30. The knuckles and washers are purposely made of a different plastic material. The force needed to provide the desired friction is generated by a torque-adjusting screw 50 which is positioned on the pivot axis of the hinge. The threaded end 51 of screw 50 is received within the internally threaded knuckle 32 of hinge component 30. The other knuckles 22 and 12 are not threaded.

The purpose of providing washers or washer-shaped surfaces 41, 42 between the end surfaces 25, 15, 16, 35 of the plastic hinge knuckles 22, 12, 32 is to eliminate the squeaking noise which is commonly encountered whenever two identical materials are rubbed together. As is known, where two identical surface materials are in contact, the coefficient of static friction is usually much higher than the coefficient of dynamic friction. The term "coefficient" is used to mean the ratio between the force required to overcome friction and the force holding the two surfaces together. The coefficient of static friction is that percentage of the force holding the two surfaces together which must be applied to start a sliding motion. The coefficient of dynamic friction is that percentage of the force holding the two surfaces together which must be applied to continue the sliding motion. When these two coefficients are widely different, as is the case where two identical surface materials are in contact with each other, the motion between the two surfaces is an intermittent stick-slip motion and results in a squeaking noise. However, with proper selection of different materials, the coefficients of static friction and dynamic friction are more nearly the same and squeaking is avoided.

In a preferred embodiment of the present application, the hinge components 10, 20, 30 are integral molded components made of a plastic material known as acetal. Hinge component 20 comprises leaf 21, knuckle 22, and stud 23. Component 30 comprises leaf 31, knuckle 32, and stud 33. Hinge component 10 comprises leaf 11, knuckle 12, and studs 13, 14. The torque adjusting screw 50 is also made of acetal. The washers 41, 42 are made of nylon. The only elements of the hinge assembly which are not made of plastic are the nuts 60 which are preferably made of steel.

Acetal is a suitable elastic and creep-resistant plastic material. By making the screw of acetal, the plastic screw acts as a spring. Once the head 53 of screw 50 has seated against the internal shoulder of knuckle 22, tightening of the screw draws the three knuckles together against the washers 41, 42. Further tightening elongates the screw slightly with each increment of torque adjustment in the tightening direction. This results in a reasonable range of screw rotation through which torque adjustment can be performed. If the screw were made of a much stiffer material, such as steel, there would be a sudden bottoming out.

The stick-slip characteristic (which results when a material has widely different coefficients of static and dynamic friction) is used to advantage in the present application in the tightening of the plastic torque-adjusting screw 50. As the screw 50 is tightened, an axial force is generated between the screw threads 51 and the underside 52 of the head 53. This force causes frictional resistance to turning with respect both to the screw threads 51 and also with respect to the head 53. Since the material of the screw 50 and of the hinge components 10, 20, 30 are identical, all being acetal, the resistance to turning of the screw 50 provides a rachet-like feel. It also provides a high resistance to accidental loosening of the screw.

Figure 5:
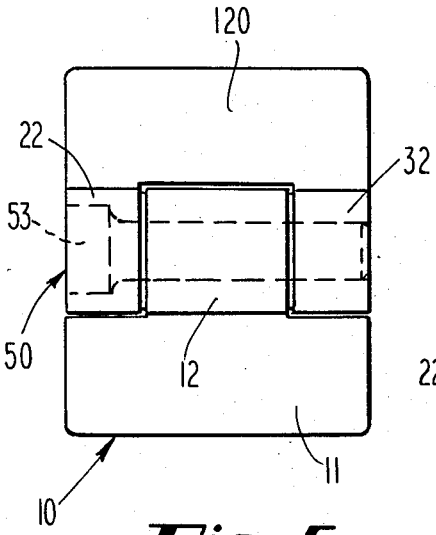
FIG. 5 is a front view of a slightly modified form of new hinge assembly.

In a preferred form of the three-knuckle hinge of the present invention, illustrated in FIGS. 1–4, the hinge leaf on one side of the pivot axis is split into two pieces, 21 and 31, rather than being one piece. This avoids the problem caused by normal production tolerances in trying to make an exact size-to-size fit between the washer faces. Although not presently preferred, it is possible to make the hinge with a one-piece leaf on each side of the pivot axis. Such a hinge is shown in FIG. 5 where leaf 120 is a one-piece leaf and takes the place of the two leaves 21 and 31.

Figure 6:
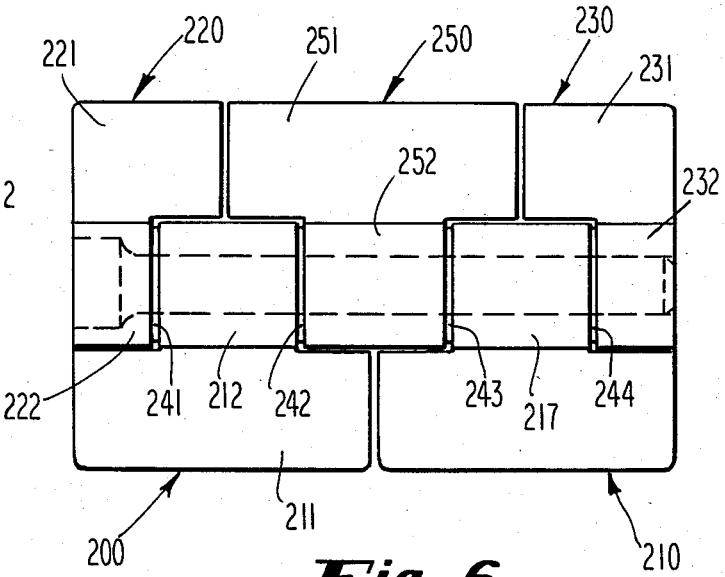
FIG. 6 is a view of a five-knuckle form of a new hinge assembly.

In FIG. 6 the hinge assembly is shown as having five leaf components, two components 200 and 210 on one side of the pivot axis and three components 220, 230, and 250 on the other side. In the form shown in FIG. 6, the hinge assembly requires four nylon washers 241–244 for four pairs of mating surfaces between the five knuckles 222, 212, 252, 217, and 232. In comparison with the three-leaf component assembly illustrated in FIGS. 1–4, the five-leaf component assembly illustrated in FIG. 6 has double the friction torque, assuming the same degree of tightness of the adjusting screw.

Actually, the number of leaves could be any odd number. The number of leaves should be odd so that the head and the threads of the adjusting screw are positioned inside of knuckles which are integral parts of leaves located on the same side of the hinge. If the screw head and screw threads are inside of knuckles of leaves located on opposite sides of the pivot axis, there would be the possibility of relative rotation between one end of the screw and one of the leaves during operation of the hinge, resulting in a possible change of torque adjustment.

Referring again to the three-leaf assembly illustrated in FIGS. 1–4, the leaf 11 on one side of the axis is provided with a pair of integral studs 13 and 14, while leaves 21 and 31 on the opposite side of the pivot axis are each provided with a single stud identified 23 and 33 respectfully. The studs 13, 14, 23 and 33 are molded as an integral part of the plastic hinge leaf, and may preferably, but not necessarily be tubular or hollow as shown in section in FIG. 4. This is merely to decrease the weight of the studs.

When molded, studs 13, 14, 23 and 33 are without external threads. The threads are formed when the nuts 60, which are preferably steel, are threaded onto the studs to secure the hinge to the panels P1, P2.

In the drawing, the pivot pin 50 is shown as having a philips type head having a recess 54 for receiving a philips type tool. It will, of course, be understood that the head 53 of the screw could have other non-circular forms of recess.

I claim:

1. An adjustable friction hinge made of different plastic materials selected to have anti-squeak characteristics when in sliding frictional engagement, said hinge comprising:

(a) first means having a leaf portion and a first knuckle projecting therefrom having a bore coaxial with the pivot axis of the hinge;

(b) second means having a leaf portion and spaced-apart knuckles projecting therefrom having bores coaxial with the pivot axis, wherein said second means comprises two separate pieces having integral therewith one of the spaced-apart knuckles;

(c) one of said spaced-apart knuckles having a non-threaded cylindrical bore having an internal shoulder and the other knuckle having an internally-threaded bore;

(d) said first knuckle positioned between said spaced-apart knuckles;

(e) said first and second means formed of a first plastic material having elastic properties;

(f) a single annular washer positioned at each end of the first knuckle, separating the ends of the first knuckle from the ends of the spaced-apart knuckle, and in direct contact with one end of said first knuckle and one end of said spaced-apart knuckles;

(g) said annular washers being formed of a second plastic material selected to be different from said first plastic material such that the coefficients of static and dynamic friction of the first and second plastic materials when in frictional engagement with each other are similar, the difference between the coefficients of static and dynamic friction being substantially less than if the first and second plastic materials were indentical, thereby to provide said hinge with anti-squeak properties, and (h) an adjustment screw formed of said first elastic plastic material positioned in the bores of said knuckles, said screw having a cylindrical head at its one end for engagement with the internal shoulder of the non-threaded knuckle and having a threaded shank at its other end for threaded engagement with the internally-threaded bore of the other knuckle of the pair, said screw being adapted to elongate slightly when tightened thereby to apply an axial force on the threads of said other knuckle, thereby to maintain the frictional adjustment of said hinge during use.

2. An adjustable friction hinge according to claim 1 wherein said cylindrical head has a non-circular recess therein for receiving an adjustment tool.

3. An adjustable friction hinge according to claim 2 wherein said first plastic material is acetal and said second plastic material is nylon.

4. An adjustable friction hinge according to claim 1 wherein said first plastic material is acetal and said second plastic material is nylon.

5. An adjustable friction hinge made of different plastic materials selected to have anti-squeak characteristics when in sliding frictional engagement, said hinge comprising:

(a) first means having a leaf portion and a first knuckle projecting therefrom having a bore coaxial with the pivot axis of the hinge;

(b) second means having a leaf portion and spaced-apart knuckles projecting therefrom having bores coaxial with the pivot axis;

(c) one of said spaced-apart knuckles having a non-threaded cylindrical bore having an internal shoulder and the other knuckle having an internally-threaded bore;

(d) said first knuckle positioned between said spaced-apart knuckles;

(e) said first and second means formed of a first plastic material having elastic properties;

(f) a single annular washer positioned at each end of the first knuckle, separating the ends of the first knuckle from the ends of the spaced-apart knuckles;

(g) said annular washers being formed of a second plastic material selected to be different from said first plastic material such that the coefficients of static and dynamic friction of the first and second plastic materials when in frictional engagement with each other are similar, the difference between the coefficients of static and dynamic friction being substantially less than if the first and second plastic materials were identical, thereby to provide said hinge with anti-squeak properties, and (h) an adjustment screw formed of said first elastic plastic material positioned in the bores of said knuckles, said screw having a cylindrical head at its one end for engagement with the internal shoulder of the non-threaded knuckle and having a threaded shank at its other end for threaded engagement with the internally-threaded bore of the other knuckle of the pair, said screw being adapted to elongate slightly when tightened thereby to apply an axial force on the threads of said other knuckle, thereby to maintain the frictional adjustment of said hinge during use, wherein said first plastic material is acetal and said second plastic material is nylon.

6. An adjustable friction hinge according to claim 5 wherein said second means comprises two separate pieces each having intergral therewith one of the spaced-apart knuckles.

7. An adjustable friction hinge according to claim 5 wherein said cylindrical head has a non-circular recess therein for receiving an adjustment tool.

* * * * *